US011536489B2

(12) United States Patent
Jensen et al.

(10) Patent No.: US 11,536,489 B2
(45) Date of Patent: Dec. 27, 2022

(54) FLUE GAS BAFFLE AND MANUFACTURING PROCESS THEREFOR

(71) Applicant: Rheem Australia Pty. Limited, Rydalmere (AU)

(72) Inventors: Jim Jensen, Killara (AU); Momtaiz Zraika, Quakers Hill (AU)

(73) Assignee: Rheem Australia Pty Limited, Rydalmere (AU)

( * ) Notice: Subject to any disclaimer, the term of this patent is extended or adjusted under 35 U.S.C. 154(b) by 212 days.

(21) Appl. No.: 16/637,342

(22) PCT Filed: Jul. 27, 2018

(86) PCT No.: PCT/IB2018/000955
§ 371 (c)(1),
(2) Date: Feb. 7, 2020

(87) PCT Pub. No.: WO2019/030562
PCT Pub. Date: Feb. 14, 2019

(65) Prior Publication Data

US 2021/0372665 A1 Dec. 2, 2021

Related U.S. Application Data

(60) Provisional application No. 62/544,403, filed on Aug. 11, 2017.

(51) Int. Cl.
*F24H 9/00* (2022.01)
*F24H 7/00* (2022.01)

(52) U.S. Cl.
CPC ..... *F24H 9/0031* (2013.01); *F24H 7/00* (2013.01)

(58) Field of Classification Search
CPC ..... F22B 37/06; F22B 13/005; F22B 13/02; F22B 13/14; F23M 9/00; F23M 9/0005;
(Continued)

(56) References Cited

U.S. PATENT DOCUMENTS 2,826,220 A * 3/1958 Young ..... F28F 13/12 138/38
3,729,901 A * 5/1973 Jackson ..... B01D 47/021 96/329

(Continued)

FOREIGN PATENT DOCUMENTS

AU 564362 B2 8/1987

OTHER PUBLICATIONS

International Search Report and Written Opinion for PCT Application No. PCT/IB2018/000955 dated Oct. 17, 2018.

*Primary Examiner* — Edelmira Bosques
*Assistant Examiner* — Michael James Giordano
(74) *Attorney, Agent, or Firm* — Eversheds Sutherland (US) LLP

(57) ABSTRACT

A flue baffle for a water heater comprises a plurality of holes along a length of the baffle and a plurality of bent blades along the length of the baffle, where each hole of the plurality of holes is adjacent to a bent blade of the plurality of bent blades. The holes are configured to permit flue gas to pass through the holes. The bent blades can have an alternating pattern where a first bent blade extends from one side of the baffle and the next bent blade extends from an opposite side of the baffle. A press tool for forming the baffle comprises a piercing tool for forming the plurality of holes and a lance and fold die for forming the bent blades.

8 Claims, 17 Drawing Sheets

(58) Field of Classification Search
CPC . F23M 9/003; F23M 9/04; F23M 9/10; F24H 1/205; F24H 9/0026; F24H 7/00; F24H 9/0031
See application file for complete search history.

(56) References Cited

U.S. PATENT DOCUMENTS

| | | | | |
|---|---|---|---|---|
| 6,354,248 | B1 * | 3/2002 | Bourke | F24H 9/0026 122/18.31 |
| 6,422,179 | B2 | 7/2002 | Hughes et al. | |
| 9,671,181 | B2 * | 6/2017 | Janezich | F28F 9/0221 |
| 2005/0241360 | A1 | 11/2005 | Miller et al. | |
| 2009/0199788 | A1 | 8/2009 | Lesage | |
| 2016/0201944 | A1 | 7/2016 | Zhang et al. | |

* cited by examiner

Gas Combustion Test #3

Model No: 347130N0 Date: 20-FEB-17

Consumption: 31 MJ/hr Serial No: Prototype #2

Sample: #6 Baffle 12 blades Ø12 holes paired

| | | |
|---|---|---|
| Gas Type: | NA | |
| Percentage overload: | 115 | % |
| Required Overload: | 35.65 | MJ/hr |
| Test Point Pressure: | 1.01 | Kpa |
| Inlet Pressure to Gas Meter | 1.17 | Kpa |
| Barometric Pressure: | 101.100 | Kpa |
| Gas Temperature: | 21.6 | ˚C |
| Correction Factor (TAB) | **0.9867** | |
| Heating Value: | 48.38 | MJ/m³ |
| Gas Meter Volume: | 10 | Litres |
| Gas Meter Correction Factor: | 1.002 | |
| Time For Above Gas Volume: | 48.17 | Seconds |
| Gas Volume: | **0.7488** | m³/hr |
| Overload Actual Gas Consumption: | **35.75** | MJ/hr |
| Percentage Overload | **115.32** | % |

Actual wobbe index 55

| TIME | CO | $CO_2$ | $CO/CO_2$ |
|---|---|---|---|
| 5 Minute | 0.573 | 11.74 | **0.0488** |
| 10 Minute | 0.335 | 11.85 | **0.0283** |
| 15 Minute | 0.328 | 11.99 | **0.0274** |
| 20 Minute | 0.381 | 11.98 | **0.0318** |

FIG. 23

Gas Combustion Test 4

| | | | |
|---|---|---|---|
| Model No: | 347130N0 | Date: | 20-Feb-17 |
| Consumption: | 31 MJ/hr | Serial No: | Prototype |
| Sample: | #6 Baffle 12 blades Ø13 holes paired | | |

| | | | |
|---|---|---|---|
| Gas Type: | NA | | |
| Percentage overload: | 115 | % | |
| Required Overload: | 35.65 | MJ/hr | |
| Test Point Pressure: | 1.01 | Kpa | |
| Inlet Pressure to Gas Meter | 1.17 | Kpa | |
| Barometric Pressure: | 101.030 | Kpa | |
| Gas Temperature: | 21.5 | °C | |
| Correction Factor (TAB) | **0.9864** | | Actual wobbe index |
| Heating Value: | 48.60 | $MJ/m^3$ | 55.05 |
| Gas Meter Volume: | 10 | Litres | |
| Gas Meter Correction Factor: | 1.002 | | |
| Time For Above Gas Volume: | 48.41 | Seconds | |
| Gas Volume: | **0.7451** | $m^3/hr$ | |
| Overload Actual Gas Consumption: | **35.75** | MJ/hr | |
| Percentage Overload | **115.32** | % | |

| TIME | CO | $CO_2$ | $CO/CO_2$ |
|---|---|---|---|
| 5 Minute | 0.477 | 11.67 | **0.0409** |
| 10 Minute | 0.252 | 11.77 | **0.0214** |
| 15 Minute | 0.252 | 11.83 | **0.0213** |
| 20 Minute | 0.261 | 11.91 | **0.0219** |

FIG. 24

Gas Combustion Test 5

| | | | |
|---|---|---|---|
| Model No: | 347130N0 | Date: | 24-Feb-17 |
| Consumption: | 31 MJ/hr | Serial No: | Prototype |
| Sample: | #6 Baffle 12 blades Ø13.5 holes paired | | |

| | | |
|---|---|---|
| Gas Type: | NA | |
| Percentage overload: | 115 | % |
| Required Overload: | 35.65 | MJ/hr |

| | | | |
|---|---|---|---|
| Test Point Pressure: | 1.01 | Kpa | |
| Inlet Pressure to Gas Meter | 1.16 | Kpa | |
| Barometric Pressure: | 102.030 | Kpa | |
| Gas Temperature: | 21.2 | °C | |
| Correction Factor (TAB) | **0.9970** | | Actual wobbe index |
| Heating Value: | 47.90 | $MJ/m^3$ | 54.91 |
| Gas Meter Volume: | 10 | Litres | |
| Gas Meter Correction Factor: | 1.002 | | |
| Time For Above Gas Volume: | 48.32 | Seconds | |
| Gas Volume: | **0.7465** | $m^3/hr$ | |

| | | |
|---|---|---|
| Overload Actual Gas Consumption: | **35.65** | MJ/hr |
| Percentage Overload | **115.00** | % |

| TIME | CO | $CO_2$ | $CO/CO_2$ |
|---|---|---|---|
| 5 Minute | 0.346 | 11.92 | **0.0290** |
| 10 Minute | 0.157 | 11.91 | **0.0132** |
| 15 Minute | 0.142 | 12.02 | **0.0118** |
| 20 Minute | 0.210 | 12.09 | **0.0174** |

FIG. 25

FLUE GAS BAFFLE AND MANUFACTURING PROCESS THEREFOR

RELATED APPLICATION

The present application claims priority to U.S. Provisional Patent Application No. 62/544,403 filed Aug. 11, 2017 and titled "Manufacturing Process For Making A Flue Gas Baffle For A Gas Storage Water Heater." The entire contents of the foregoing application are hereby incorporated herein by reference.

TECHNICAL FIELD

The present disclosure relates generally to water heaters and particularly to a process for manufacturing a flue baffle.

BACKGROUND

Boilers, water heaters, and other similar devices can comprise a water storage tank and a heating source. For example, the heating source in gas water heaters typically comprises a combustion chamber in which a fuel is burned. The combustion process in the combustion chamber heats the water in the storage tank. The combustion process also produces combustion gases that exit the water heater by traveling through one or more flue tubes. In addition to the heat from the combustion chamber heating the water in the storage tank, heat from the combustion gases passes from the flue tube(s) into the water storage tank providing supplemental heat to the water.

It is common to place a baffle within the flue tube to mix and partially restrict the flow of the combustion gases within the flue tube thereby improving the transfer of heat from the combustion gases within the flue tube to the water in the storage tank. However, existing baffles have limitations. For example, baffles typically have blades or folds to restrict the flow of the combustion gases. However, existing manufacturing processes used to provide the blades or folds in the baffle tend to have a high degree of variability. In other words, existing manufacturing processes are limited in their ability to consistently control the shape of the blades and folds in the baffle. This variability is due in part to the nature of the material used to make the baffle and its inherent tendency to spring-back after being folded or bent. This variability also can be due in part to variations in the material used to form the baffle.

Precise control of the manufacturing of the baffle can provide improvements in the performance of the baffle and, thereby, the efficiency of the water heater. Additionally, precise control of the manufacturing of the baffle can allow the manufacturer to customize the design of the baffle to meet specific performance criteria for varying water heaters. Furthermore, precise control of the manufacturing of the baffle can also control the production of carbon monoxide during operation of the water heater.

The following disclosure describes example manufacturing processes for producing a baffle that can address one or more of the foregoing limitations associated with existing baffles for water heaters and other similar devices.

SUMMARY

The present disclosure describes example embodiments of a baffle to be inserted in a flue. In one example, a method of manufacturing a baffle for a flue comprises using an indexing tool operated by a controller to feed a unitary piece of material into a press tool to a first position. At the first position, a piercing tool operated by the controller pierces the unitary piece of material forming a plurality of holes, wherein the size of the plurality of holes is selected to effect a performance characteristic of the baffle. After the piercing step, the indexing machine advances the unitary piece of material to a second position within the press tool where a lance and fold die operated by the controller forms a plurality of bent blades in the unitary piece of material, where each of the bent blades is adjacent to a hole of the plurality of holes. The indexing machine can advance the unitary piece of material out of the press tool. Alternatively, the foregoing steps performed by the piercing tool and lance and fold die can be repeated on additional sections of the unitary piece of material to form the baffle. In certain example embodiments, the lance and fold die is shaped so that the plurality of bent blades have varying length with shorter bent blades toward a combustion end of the baffle and longer bent blades toward a hanger end of the baffle.

In another example, a baffle for a flue comprises a strip of material comprising a plurality of holes, each hole of the plurality of holes adjacent to a bent blade. Each hole of the plurality of holes is oriented to permit flue gases to pass through the hole. In some example embodiments, the bent blades are formed in an alternating pattern with one blade extending from a first side of the strip of material and the next blade extending from an opposite side of the strip of material. In certain example embodiments the bent blades extend at an acute or at a 90 degree angle with respect to the strip of material. Additionally, in certain example embodiments the bent blades comprise a gusset at the point where the bent blade extends from the strip of material. In certain example embodiments, the bent blades have varying length with shorter bent blades toward a combustion end of the baffle and longer bent blades toward a hanger end of the baffle.

In yet another example, a water heater comprises a baffle within a flue, the baffle comprising a strip of material comprising a plurality of holes, each hole of the plurality of holes adjacent to a bent blade. Each hole of the plurality of holes is oriented to permit flue gases to pass through the hole. In some example embodiments, the bent blades are formed in an alternating pattern with one blade extending from a first side of the strip of material and the next blade extending from an opposite side of the strip of material. In certain example embodiments the bent blades extend at an acute or at a 90 degree angle with respect to the strip of material. Additionally, in certain example embodiments the bent blades comprise a gusset at the point where the bent blade extends from the strip of material. In certain example embodiments, the bent blades have varying length with shorter bent blades toward a combustion end of the baffle and longer bent blades toward a hanger end of the baffle.

BRIEF DESCRIPTION OF THE DRAWINGS

Reference will now be made to the accompanying drawings, which are not necessarily drawn to scale, and wherein:

FIG. 23 is a table with combustion data in accordance with example embodiments of this disclosure.

FIG. 24 is a table with combustion data in accordance with example embodiments of this disclosure.

FIG. 25 is a table with combustion data in accordance with example embodiments of this disclosure.

DESCRIPTION OF EXAMPLE EMBODIMENTS

The example embodiments discussed herein are directed to systems, apparatuses, and methods for manufacturing a baffle for a water heater. Specifically, the embodiments described herein use a more precise approach of piercing the baffle material to control the accuracy of the holes formed in the baffle material. The greater ability to control the accuracy of the holes in the material permits customization of the size of the holes in the baffle thereby permitting one to tailor the baffle to meet a specific design or performance requirement. The following embodiments are non-limiting examples and those working in this field should understand that various modifications can be applied to the examples described herein without departing from the scope of this disclosure.

Figure 1:
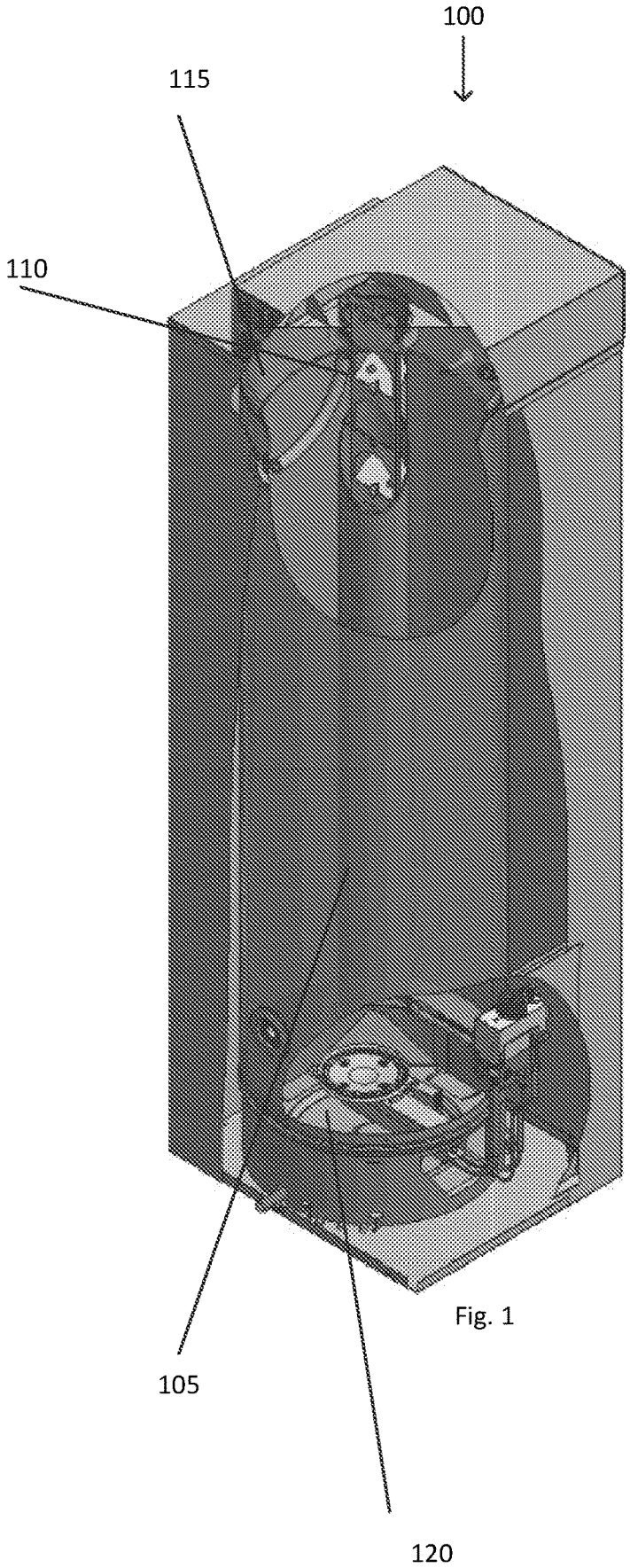
FIG. 1 is a partial cross-sectional illustration of a water heater with a baffle manufactured in accordance with an example embodiment of this disclosure.
Figure 2:
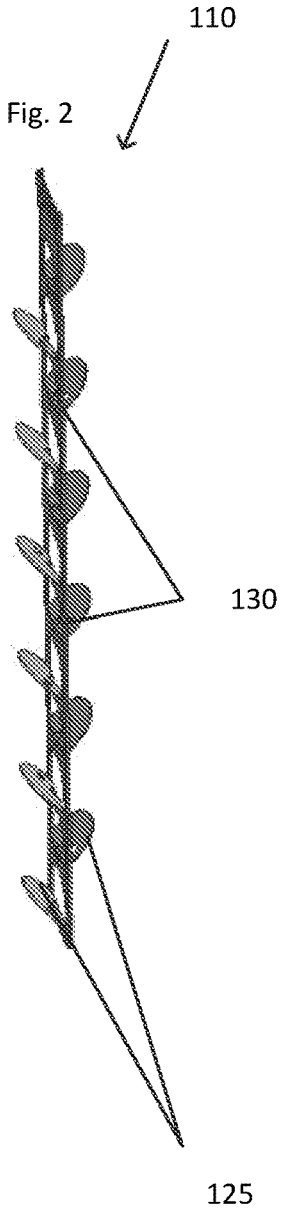
FIG. 2 is a perspective view of the baffle of FIG. 1 in accordance with an example embodiment of this disclosure.
Figure 3:
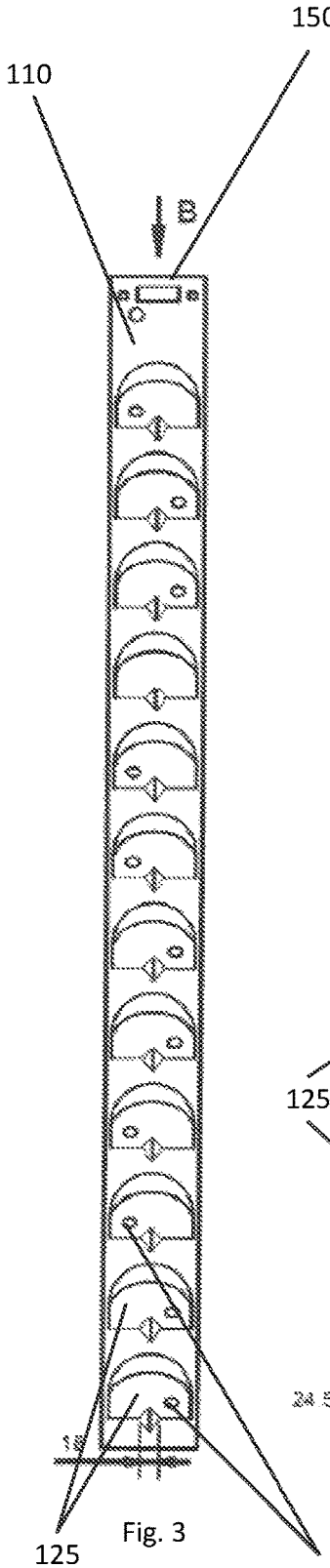
FIG. 3 is a front view of the baffle of FIG. 1 in accordance with an example embodiment of this disclosure.
Figure 4:
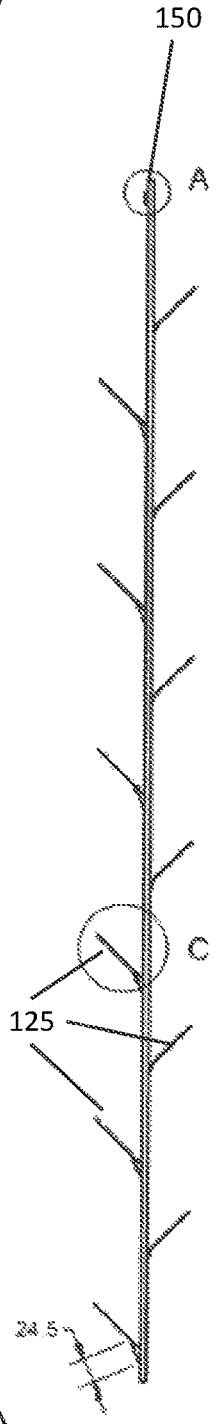
FIG. 4 is a side view of the baffle of FIG. 1 in accordance with an example embodiment of this disclosure.
Figure 7:
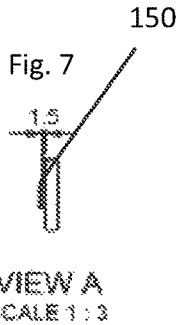
FIG. 7 is an enlarged side view of the hanger portion of the baffle of FIG. 1 in accordance with an example embodiment of this disclosure.
Figure 8:
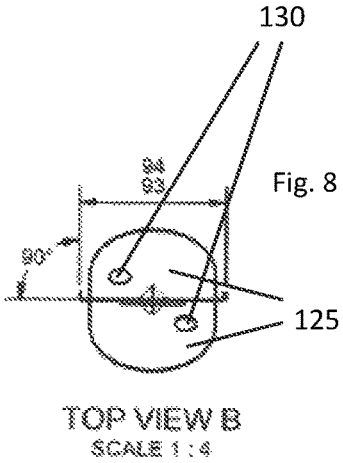
FIG. 8 is an enlarged top view of the baffle of FIG. 1 in accordance with an example embodiment of this disclosure.

Referring to the example embodiment shown in FIGS. 1-8, the improved baffle 110 of the present disclosure can be used with a flue tube 105 of a water heater 100 as shown in FIG. 1 to improve a performance of the water heater 100. The example illustrated in FIG. 1 shows a flue tube 105 within a water storage tank 115 mounted above a combustion chamber 120 of a gas burning water heater. However, the example embodiments described herein can be applied to other types of baffles. The baffle 110 shown in FIGS. 1-8 comprises a unitary piece of material in the shape of a strip that is formed into the baffle 110. The baffle 110 is typically made of steel and is formed using a press tool, although other materials and tools can be used to form the baffle of the present disclosure.

Figure 6:
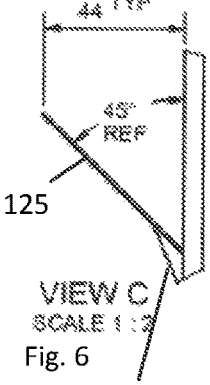
FIG. 6 is an enlarged side view of a portion of the baffle of FIG. 1 in accordance with an example embodiment of this disclosure.

As shown in the example illustrated in FIGS. 1-8, the baffle comprises a series of blades 125 in an alternating pattern along its length. In other words, moving along the length of the baffle 110 from the bottom end (also referred to as the combustion end) toward the top end (also referred to as the hanger end), a first blade 125 extends from a first side of the baffle 110, a second blade 125 adjacent to the first blade extends from a side of the baffle opposite the first side, and a third blade 125 adjacent the second blade extends from the first side of the baffle 110. In alternate embodiments, the alternating pattern of the blades 125 can vary, for example, with two consecutive blades extending from the first side of the baffle and the next two consecutive blades extending from the opposite side of baffle. In the example shown in FIGS. 1-8, the blades are formed using a lance and fold die component of the press tool so that they extend from the main body of the baffle at a 45 degree angle. In alternate embodiments, the angle between the baffle and the blades can be varied to meet particular applications or performance specifications. Additionally, FIG. 6 illustrates an optional gusset 140 that can be formed at the base of the blade to provide rigidity.

Figure 5:
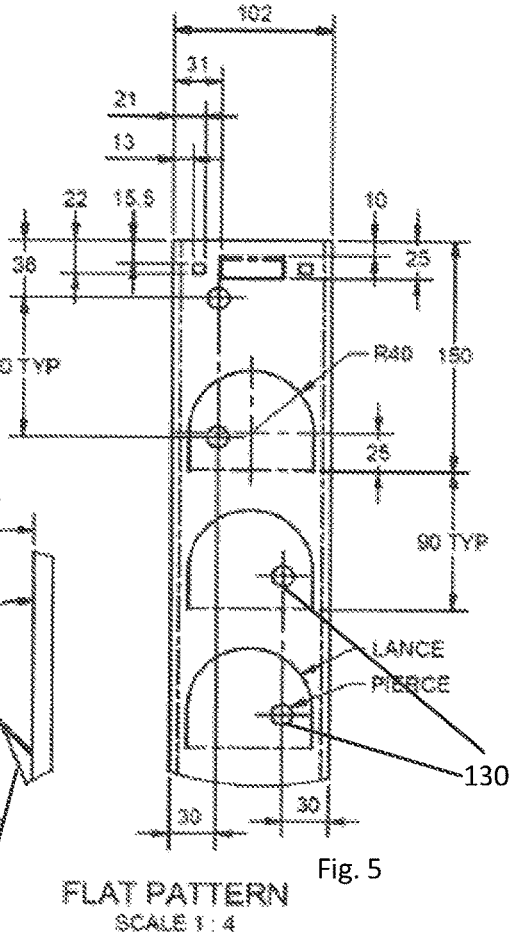
FIG. 5 is an enlarged view of a portion of the baffle of FIG. 1 before the blades have been lanced in accordance with an example embodiment of this disclosure.

Also along the length of the baffle 110, a plurality of holes 130 have been pierced using a piercing tool component of the press tool. Flue gases from the combustion chamber 120 flow up along the baffle 130 and through the holes 130 eventually exiting the flue through an exhaust port. In the example shown in FIGS. 1-8, most of the blades have a single hole 130 and the holes are formed in alternating pattern. However, in other embodiments, the blades may have multiple holes and may be formed in other patterns or positions. FIG. 5 shows the positions of the holes 130 on the baffle 110 in millimeters in accordance with one non-limiting example. The nature of the piercing tool and the shape of the holes formed by the piercing tool can be controlled with greater precision than the lancing and folding of the blades. In the example illustrated in FIGS. 1-8, the folding of the blades can be controlled within a manufacturing tolerance of 1.0 mm, whereas the manufacturing tolerance of the pierced holes can be controlled to within a tolerance of 0.1 mm. This greater accuracy in the formation of the holes 130 permits fine tuning of the baffle for desired performance characteristics as illustrated by the data in FIGS. 23-25.

FIGS. 23-25 contain examples of combustion test data illustrating the precision with which the performance characteristics of the baffle can be controlled by the accurate control of the pierced hole dimensions.

The example data in FIGS. 23-25 show tests performed using three baffles with differing hole sizes of 12 mm, 13 mm, and 13.5 mm. As shown by the test data, increasing the hole sizes from 12 mm to 13.5 mm produces a decrease in carbon monoxide formation. Reducing carbon monoxide is a safety and code requirement. For example, water heaters are typically only allowed a maximum carbon monoxide to carbon dioxide ratio of 0.02. However, maintaining the combustion ratio as close to the maximum ratio limit as possible will optimize the performance of the water heater. Precisely controlling the ratio of carbon monoxide to carbon dioxide for each varying type of water heater in which the baffle is inserted allows one to optimize the performance of the water heater while staying within the code requirement. Currently, the industry recognizes the difficulties in producing consistent baffles. Therefore, to compensate for the variability in the prior art baffles, water heaters operate at less than optimal performance to ensure that the water heater remains compliant with the carbon monoxide code requirement. The more precisely manufactured holes of the baffles manufactured using the example processes described herein allows for more precise operation of the water heater and allows the water heater to operate closer to the maximum carbon monoxide to carbon dioxide ratio while remaining within the required limits.

The precise control over the size of the holes formed in the baffle allows one to tune a baffle for specific performance requirements in a variety of types and sizes of water heaters. In contrast, the lack of precision in the folding of the blades alone does not permit one to easily control the performance of the baffle by modifying the shape or position of the blades. Experience indicates that the shape and position of the blade contributes to approximately 80% of the baffle's performance, whereas the holes in the baffle contribute to approximately 20% of the baffle's performance. Thus, while the holes in the baffle have a smaller impact on the overall performance, the precise control that can be achieved with the piercing process allows for precise tuning of the performance of the baffle.

Figure 9:
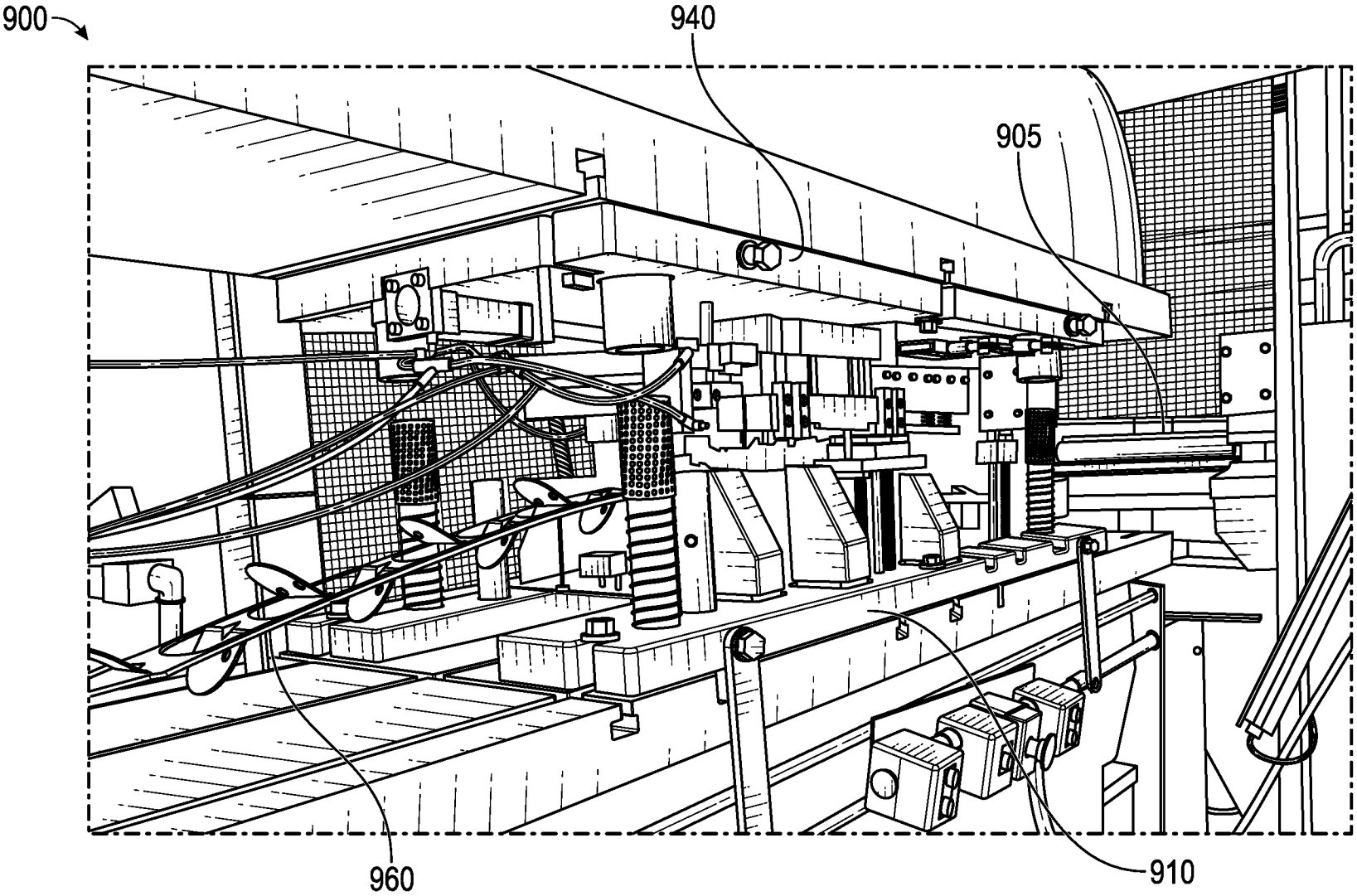
FIG. 9 is perspective view of a press tool with tool components for manufacturing a baffle in accordance with example embodiments of this disclosure.

Referring now to FIGS. 9-18, example equipment and an example method for the manufacture of the baffle of the present disclosure and is shown. FIG. 9 illustrates an example press tool 900 with a formed baffle 960 exiting the press tool in accordance with an example embodiment of the present disclosure. The press tool 900 comprises a bottom portion 910 and a top portion 940 which are pressed together to form the features of the baffle 960. FIG. 9 also shows an example indexing tool 905 for controlling the feed into the press tool 900 of the unitary strip of material that is formed into the baffle 960.

Figure 10:
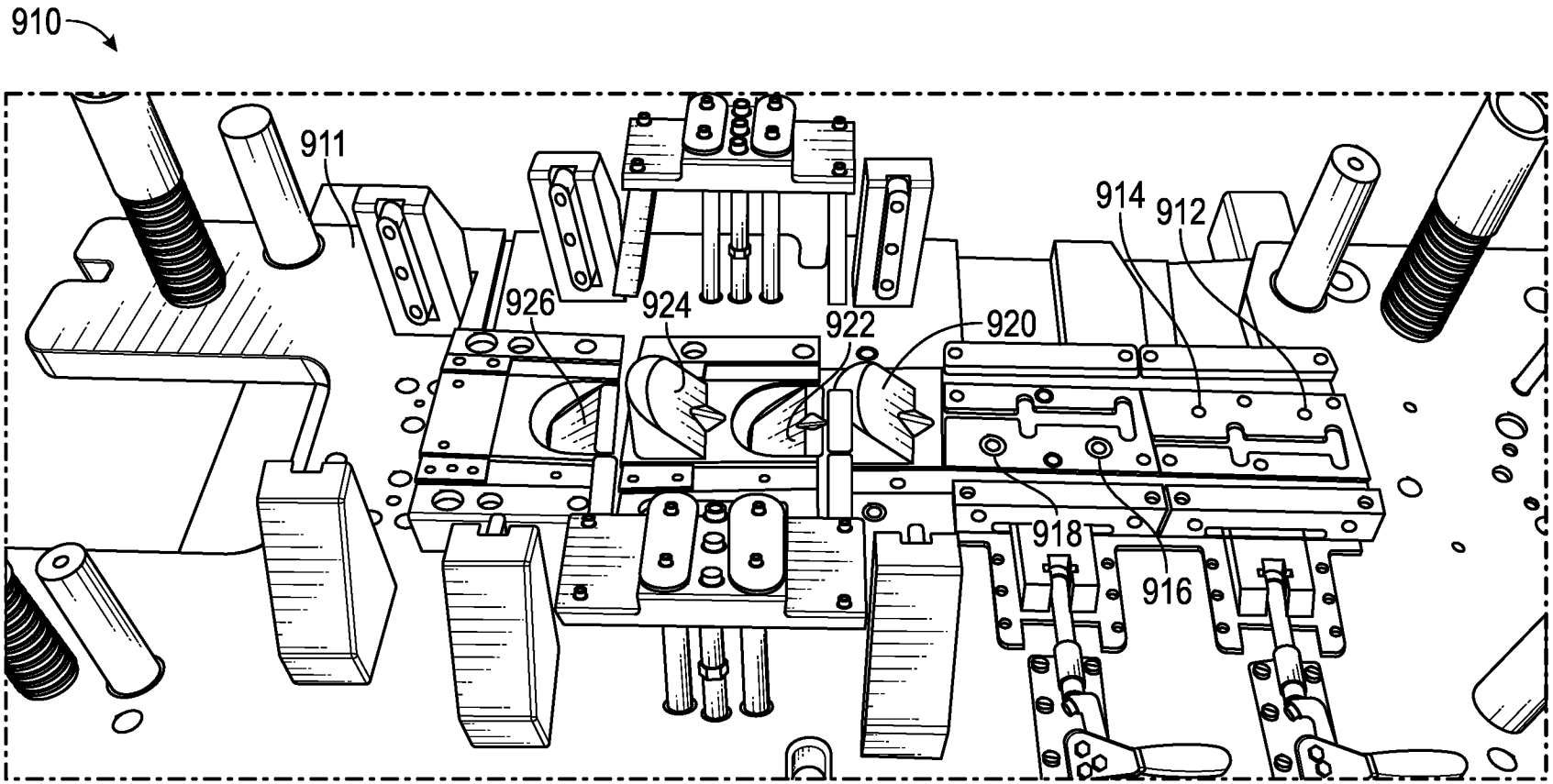
FIG. 10 is a top perspective view of the bottom half of the press tool of FIG. 9 in accordance with example embodiments of this disclosure.
Figure 11:
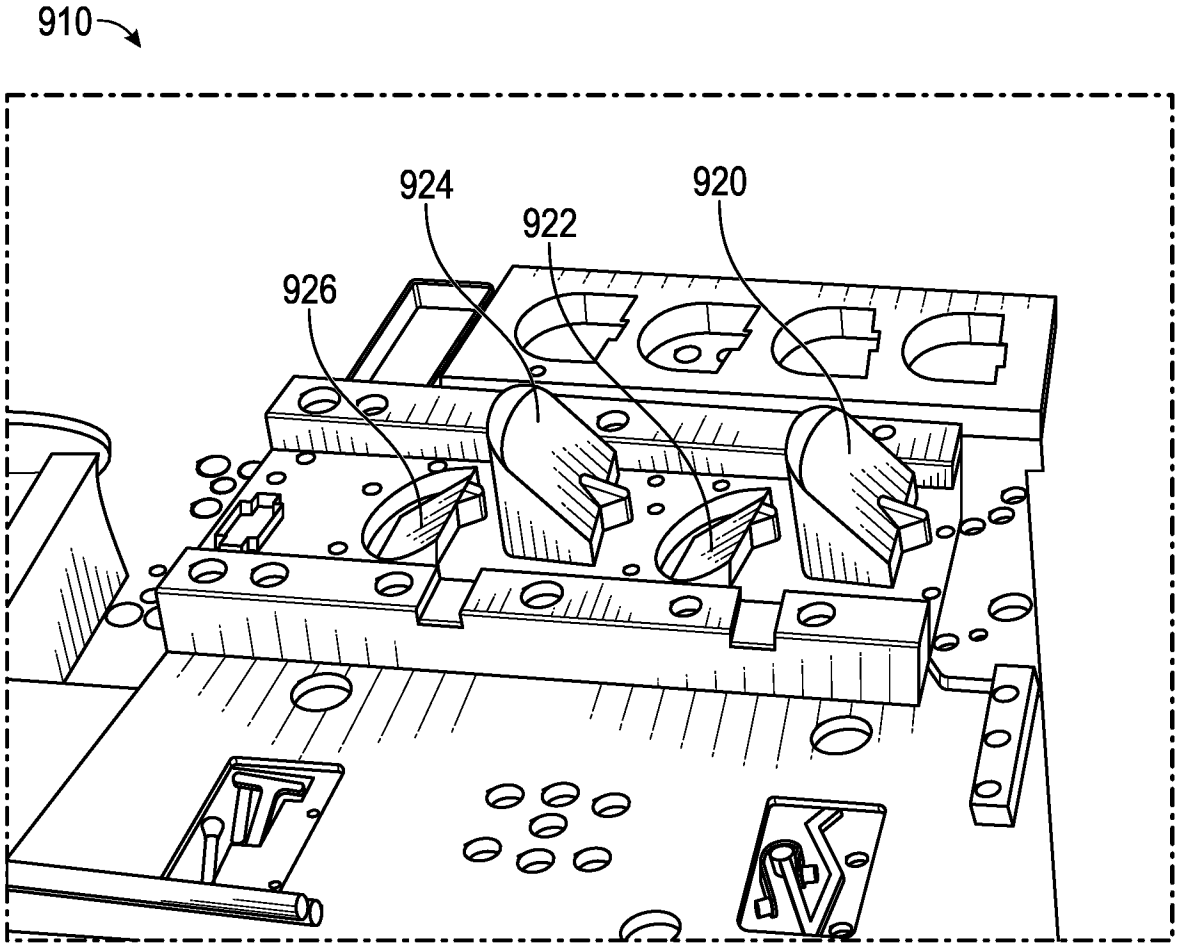
FIG. 11 is an enlarged top perspective view of a portion of the bottom half of the press tool of FIG. 9 in accordance with example embodiments of this disclosure.
Figure 12:
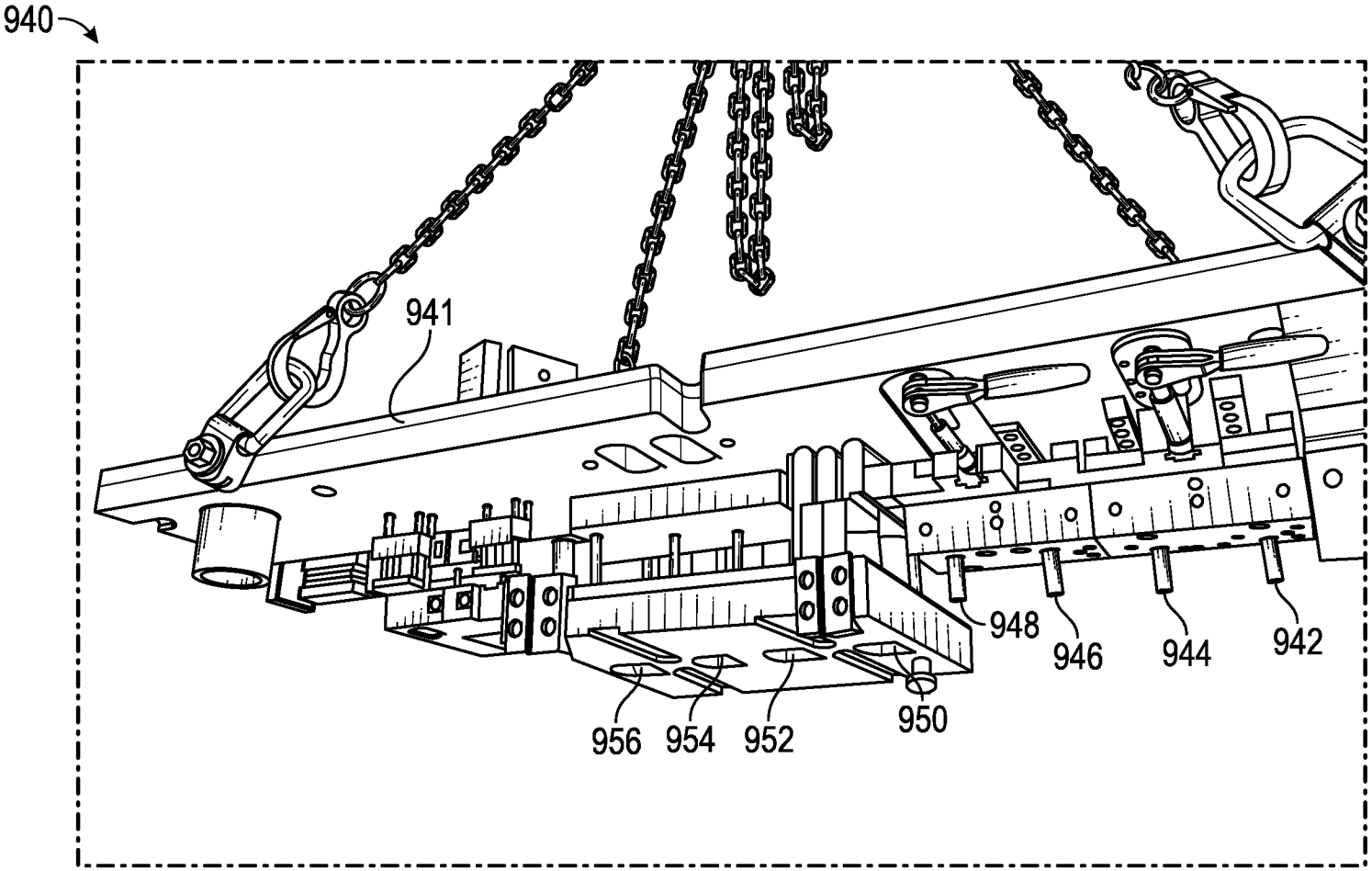
FIG. 12 is a bottom perspective view of the top half of the press tool of FIG. 9 in accordance with example embodiments of this disclosure.

FIGS. 10 and 11 show the bottom portion 910 and FIG. 12 shows the top portion 940 of the example press tool 900. The bottom portion 910 comprises four piercing apertures 912, 914, 916, and 918 for receiving piercing dies 942, 944, 946, and 948 (shown in FIG. 12) that together form the piercing tool. The four piercing apertures and four piercing dies form the holes, such as holes 130 in FIGS. 1-8, along the baffle. The bottom portion 910 of the press tool 900 also comprises four lancing dies 920, 922, 924, and 926 that are received by four lancing apertures 950, 952, 954, and 956 in the top portion 940, that together form the lance and fold die. The four lancing dies and four lancing apertures form the blades, such as blades 125 in FIGS. 1-8, along the baffle. In alternate embodiments, the top and bottom portions of the press tool can have different numbers and arrangements of dies and apertures for varying the blades and holes of the baffle to meet the requirements of particular applications.

Figure 13:
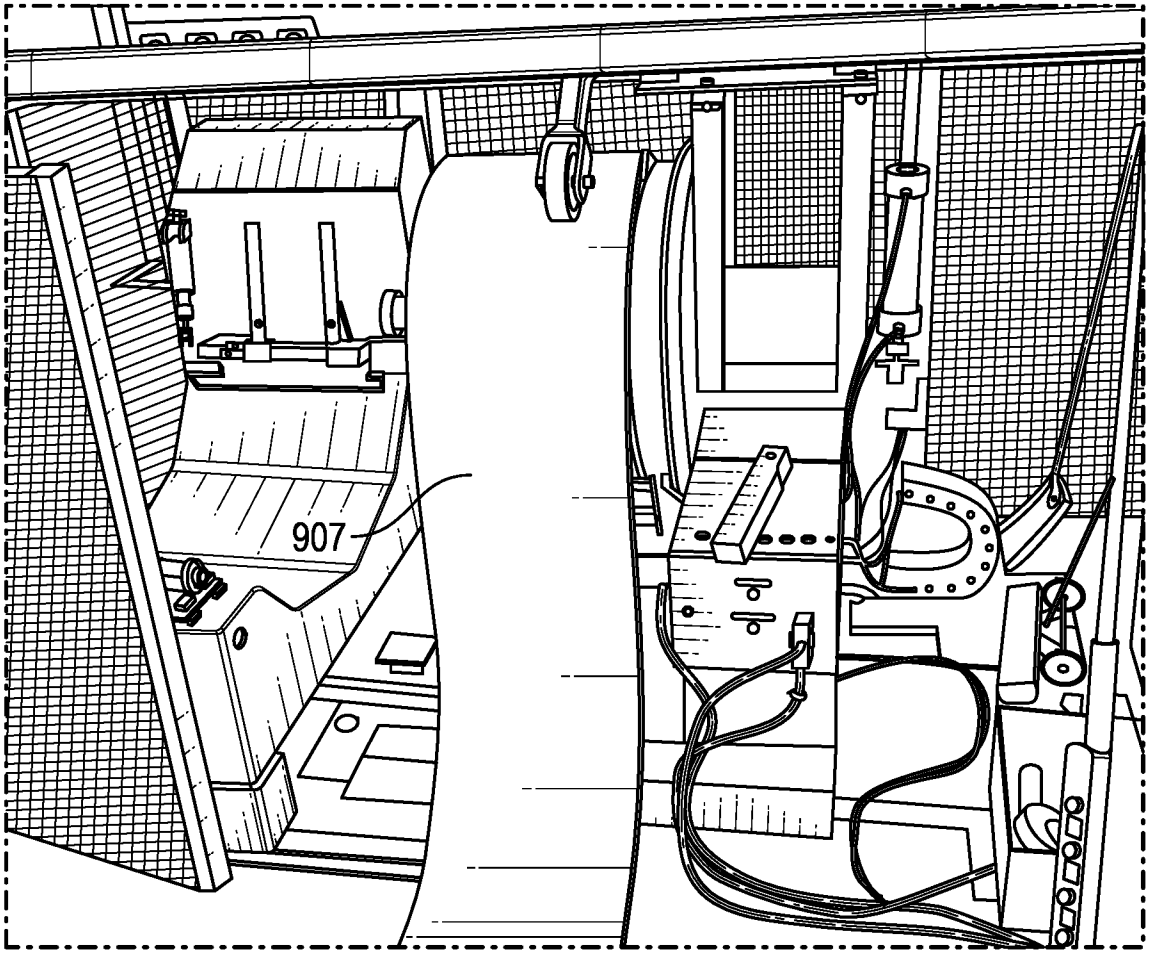
FIG. 13 shows an example of an off coiling machine from which material can be fed to the press tool in accordance with example embodiments of this disclosure.
Figure 14:
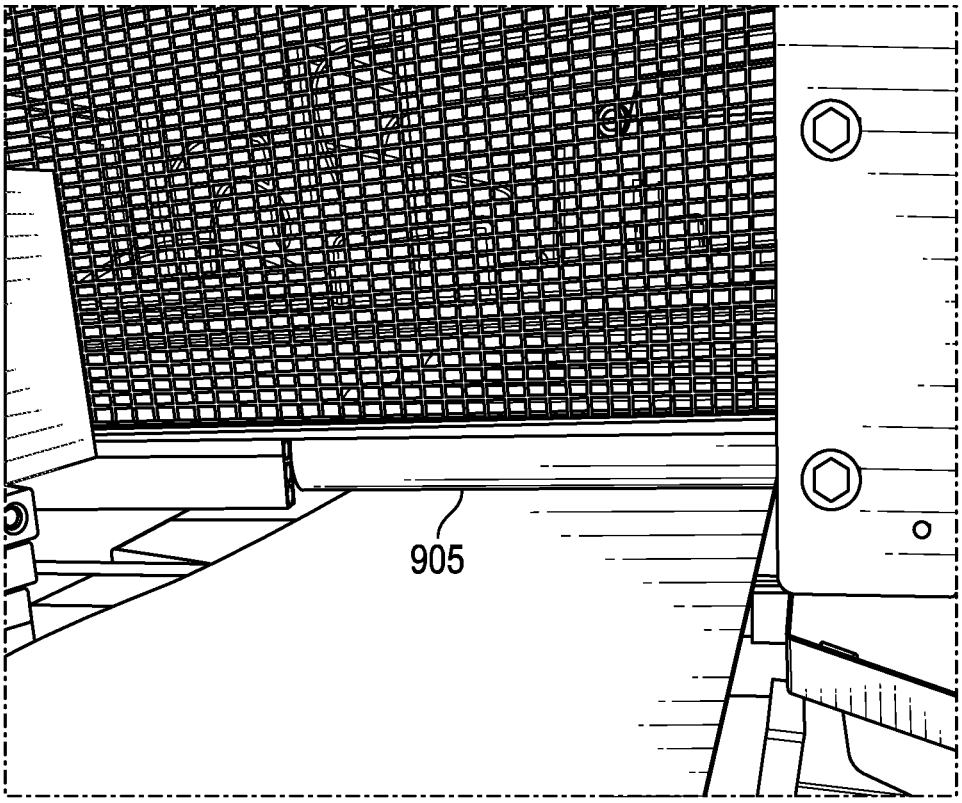
FIG. 14 shows an example of an indexing machine for straightening material and feeding material to the press tool in accordance with example embodiments of this disclosure.
Figure 18:
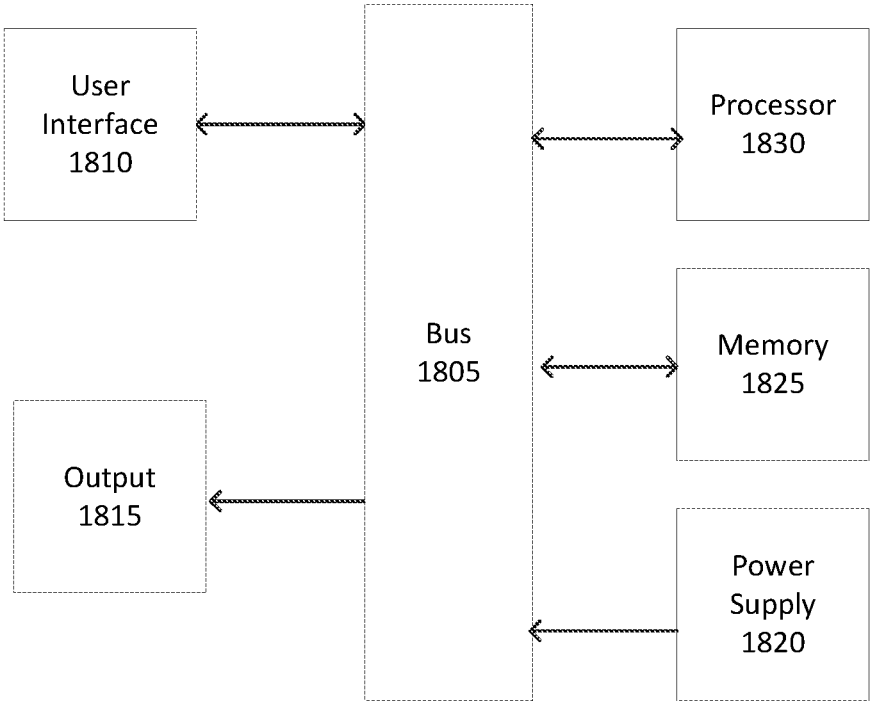
FIG. 18 shows a schematic diagram of an example programmable logic controller that can be used to control the press tool in accordance with example embodiments of this disclosure.

Material, such as steel, can be fed from a coil 907 as shown in FIG. 13 into the press tool 900. The indexing machine 905, shown in greater detail in FIG. 14 straightens the material and controls the position of the material as it is fed into the press tool 900. The operation of the indexing machine and the press tool can be controlled by a single programmable logic controller as shown in FIG. 18, or they can be controlled by multiple PLCs. PLCs are well-known to those working in this field. As an example, FIG. 18 shows the primary components of a PLC, including a power supply 1820, a processor 1830, a memory 1825, a user interface 1820, and an output 1815, all of which are coupled to a bus 1805 that handles communication between the different components of the PLC. The memory 1825 can store instructions programmed by a user via the user interface 1810 for controlling the operation of the indexing machine 905 and/or press tool 900 via control signals provided by the output 1815. In alternate embodiments, other types of controllers can be used to perform the manufacturing methods encompassed by this disclosure.

Figure 15:
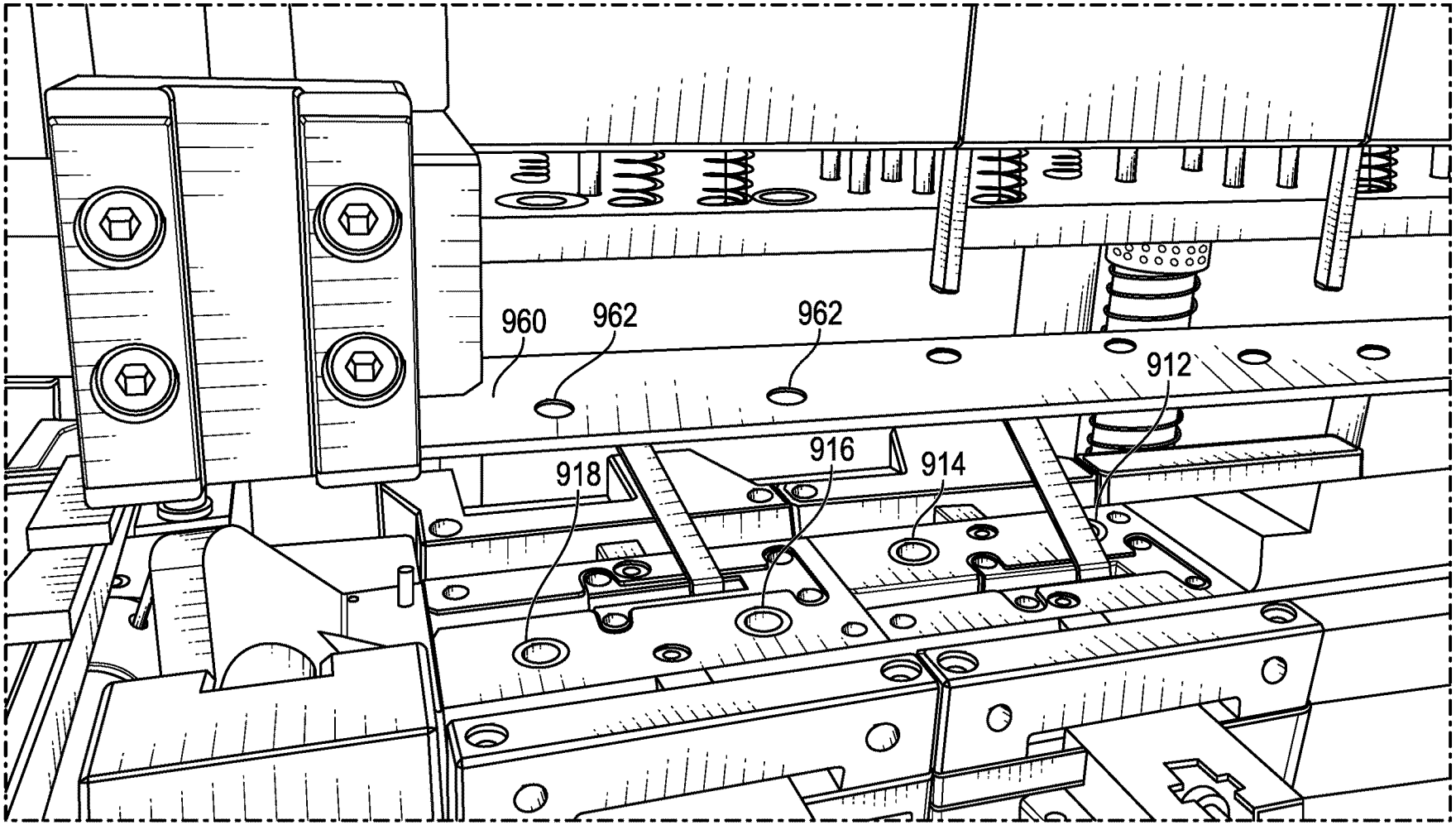
FIG. 15 shows an enlarged view of the first stage of the press tool after the piercing tool has pierced holes in the baffle in accordance with an example embodiments of this disclosure.

As shown in FIG. 15, the material for the baffle 960 is fed into one end of the press tool 900 to a first position where the piercing tool pierces a plurality of holes 962 along a length of the material using the four piercing apertures 912, 914, 916, and 918 and four piercing dies 942, 944, 946, and 948. In the example shown in FIG. 15, the piercing tool pierces four holes 962 at a time, however, in other embodiments a greater or fewer number of holes can be pierced with each motion of the piercing tool. In the example shown in FIG. 15, the piercing tool forms the holes 962 in an alternating pattern in order to control the movement and turbulence of the combustion gases that will flow along the baffle. In alternate embodiments, the pierced holes can have different shapes or be pierced in different alternating patterns.

Figure 16:
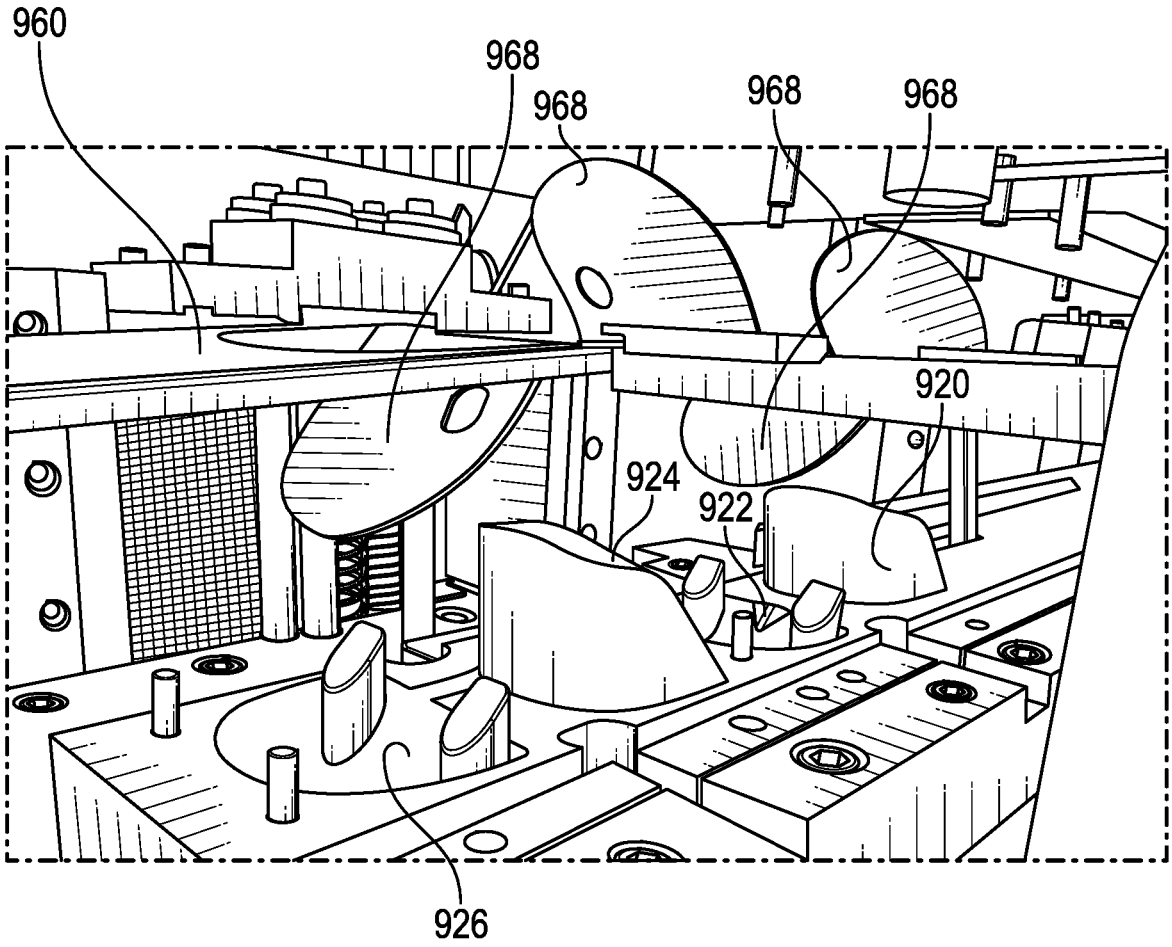
FIG. 16 shows an enlarged view of the lance and fold dies of the press tool in accordance with example embodiments of this disclosure.

After the holes 962 are pierced, the indexing machine advances the material to a second position in the press tool so that the lance and fold dies can form the blades of the baffle. As shown in the example of FIG. 16, the four lancing dies 920, 922, 924, and 926 are positioned to form the blades 968 in an alternating pattern. Additionally, the holes have been spaced so that each blade has no more than one hole. The lance and fold die shown in FIG. 16 is designed to form a gusset at the base of the blade in order to provide the blade with increased rigidity. After the blades are formed in the material, the indexing machine can advance the material so that it moves out of the press tool 900. Alternatively, the press tool can also be configured to form a hanger feature at one end of the baffle, such as the hanger feature 150 illustrated in FIGS. 3-8 or the hanger feature 974 shown in FIG. 17, to mounting the baffle within the water heater.

Figure 17:
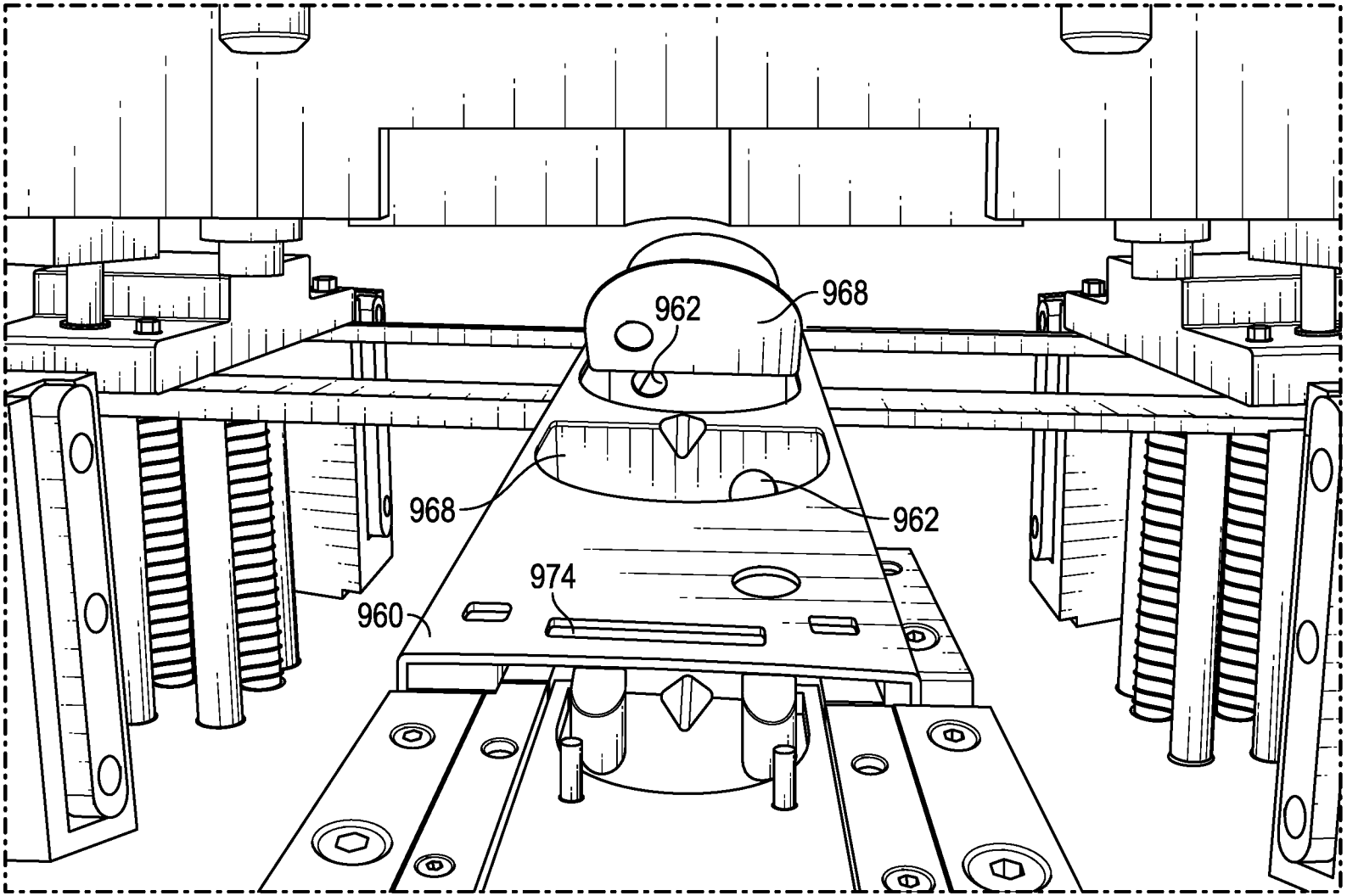
FIG. 17 shows the finished baffle exiting the press tool in accordance with example embodiments of this disclosure.

FIG. 17 shows the formed baffle 960 exiting the press tool 900. As can be seen in FIG. 17, the formed baffle 960 comprises the hanger feature 974, the holes 962, after they have been formed by the piercing tool, and the blades 968, after they have been formed by the lance and fold die.

Figure 19:
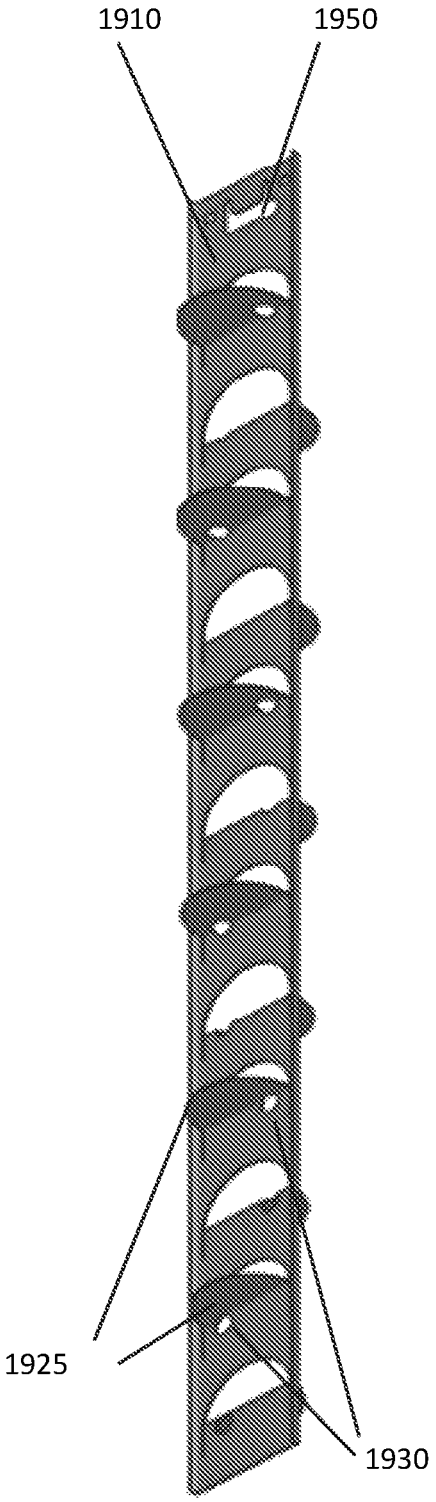
FIG. 19 is a perspective view of another embodiment of a baffle in accordance with an example embodiment of this disclosure.
Figure 20:
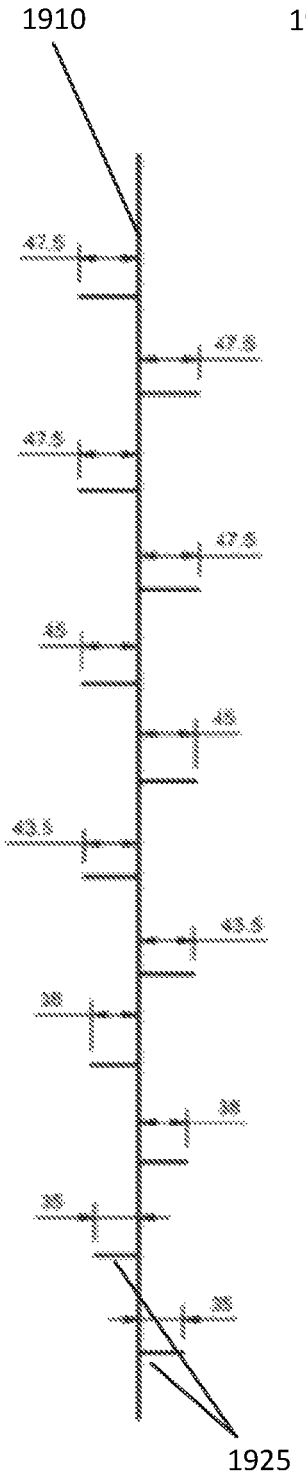
FIG. 20 is a side view of the baffle of FIG. 19 in accordance with an example embodiment of this disclosure.
Figure 21:
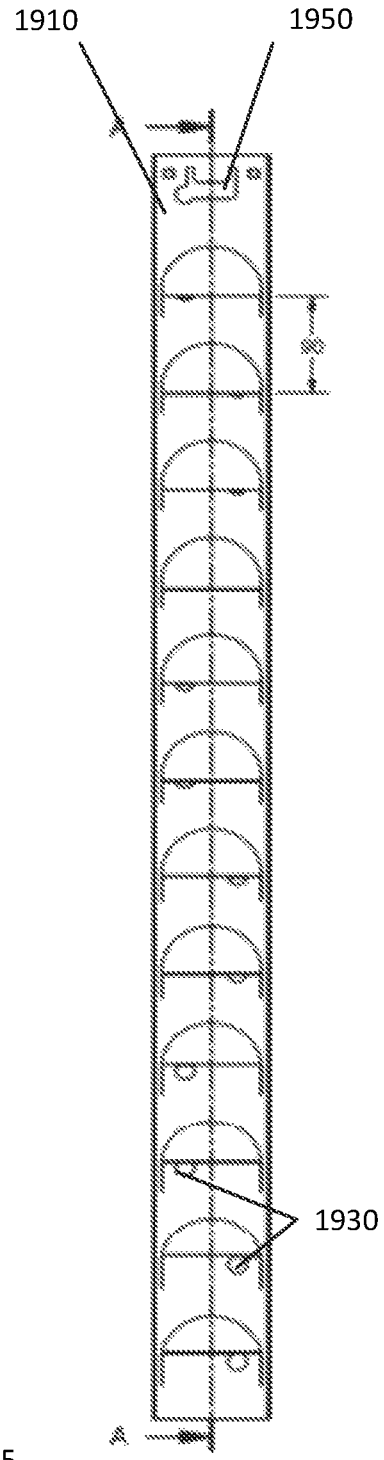
FIG. 21 is a front view of the baffle of FIG. 19 in accordance with an example embodiment of this disclosure.

Turning to FIGS. 19-21, an alternate embodiment for a baffle 1910 is illustrated. Current flue baffles used in storage water heaters typically repeat the same pattern and geometry along the length of the baffle. However, this consistent repeating of pattern and geometry along the length of the baffle is not optimal because the flue gases are initially very hot and less dense towards the bottom of the baffle near the combustion chamber, but the flue gases cool and shrink in volume (increase in density) as they travel up through the flue. The change in density of the combustion gas in the flue also causes undesirably large changes in pressure along the flue. In natural draft gas heaters, the buoyant force available to push the flue gas through the flue is relatively small, approximately 20 Pa. Therefore, to maximize heat transfer from the combustion gases to the water, resistance along the baffle should increase moving up along the baffle toward the flue exit. Increasing the resistance along the baffle toward the flue exit also assists in minimizing the change in pressure through the flue from the flue entrance at the combustion chamber to the flue exit.

Baffle 1910 is similar to the baffles previously described in that it comprises blades 1925 and holes 1930 along the length of the baffle 1910 to precisely control the performance of the baffle and the water heater. Baffle 1910 also comprises a hanger feature 1950 for hanging the baffle within a flue. However, baffle 1910 is distinct from the baffles previously described herein in that the blades 1925 increase in size moving from the bottom (combustion end) to the top (hanger end) of the baffle 1910 thereby increasing resistance for the combustion gas as it moves from the flue entrance at the combustion chamber to the flue exit. As illustrated in FIG. 20, the length of the blade increases from 35 mm, at the combustion end of the baffle 1910, to 47.5 mm, at the hanger end of the baffle 1910. Increasing the length of the blade moving from the bottom to the top of the baffle causes increasing resistance moving from the bottom to the top of the baffle.

Figure 22:
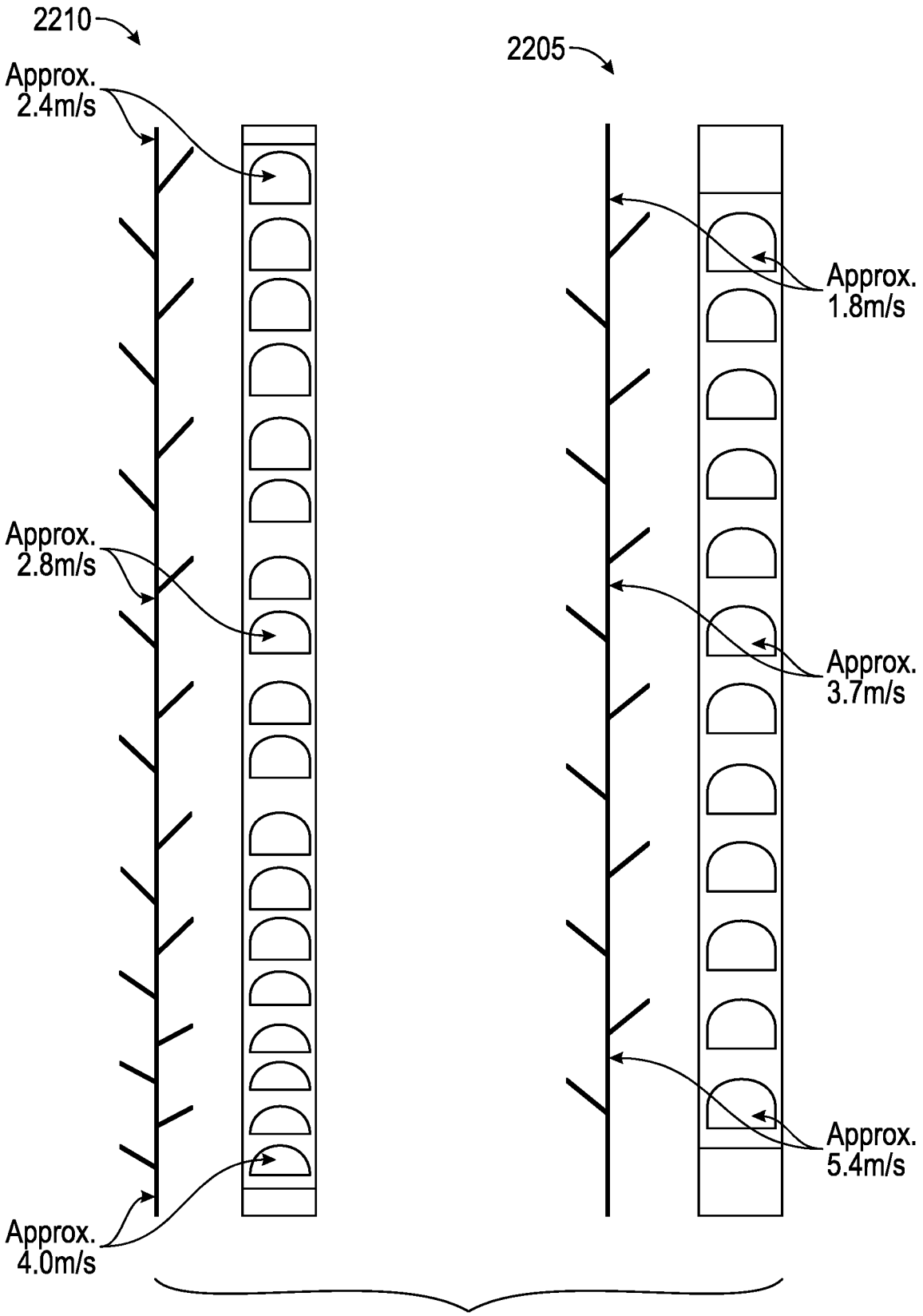
FIG. 22 illustrates a comparison of the velocity of flue gas about two different baffles in accordance with example embodiments of this disclosure.

As illustrated in FIG. 22, increasing the length of the blades moving from the bottom of the baffle (the combustion end) to the top of the baffle (the hanger end) provides a more consistent speed of the flue gases (or, said another way, more consistent restriction of the flue gases), thereby maximizing the efficiency of heat transfer from the flue gases to the water being heated. FIG. 22 illustrates a comparison of test data for flue gases rising from bottom to top along an example baffle 2210 with blades of increasing length from the combustion end to the hanger end and an example baffle 2205 with blades of consistent length along the length of the baffle 2205. As shown from the approximate measurements indicated in FIG. 22, the speed of the flue gases passing along baffle 2210 is more consistent than the speed of flue gases passing along baffle 2205, which indicates less significant changes in pressure along the flue. In other words, in this particular set of test data, the flue gases rising from the bottom to the top along baffle 2210 varied from a speed of approximately 4.0 m/s at the bottom (combustion end), to a speed of approximately 2.8 m/s at the approximate midpoint, to a speed of approximately 2.4 m/s at the top end (hanger end) of the baffle 2210. In contrast, the speed of the flue gases rising along baffle 2205 had a greater variation starting at approximately 5.4 m/s at the bottom end, dropping to approximately 3.7 m/s at the approximate midpoint, and dropping further to approximately 1.8 m/s at the top of the baffle.

The example embodiment illustrated in FIGS. 19-21 illustrates an additional variation in that the blades 1925 are formed at right angles with the baffle 1910. Forming the blades 1925 at a 90 degree angle can be beneficial in that small variations in the blade angle due to manufacturing would have little effect on the restriction of the flue gases and fine-tuning of the flue gas flow can be adjusted by the holes 1930 along the baffle. The varying length of the blades in this example embodiment may also cause some of the holes 1930 to be positioned adjacent to the blade 1925, as opposed to on the blade. Nonetheless, the position and size of the holes 1930 can be adjusted more precisely than that of the blades to more accurately control the performance of the baffle and the water heater.

Using the example methods illustrated and described herein, an improved and simplified manufacturing process is provided that allows one to customize the baffle without requiring substantial changes to the manufacturing process. For example, the press tool can easily produce baffles of varying lengths and with varying numbers of blades without replacing the piercing tool and the lance and fold die. Additionally, the flow of combustion gases through the flue can be precisely controlled by selecting the size of the holes pierced in the baffle. The size of the holes pierced in the baffle can be easily modified by replacing the piercing tool with another piercing tool having different dimensions.

While example embodiments of methods for manufacturing baffles for water heaters are discussed herein, the principles of the described embodiments can be applied to a variety of types of manufacturing processes for water heaters. Accordingly, many modifications of the embodiments set forth herein will come to mind to one skilled in the art having the benefit of the teachings presented in the foregoing descriptions and the associated drawings. Therefore, it is to be understood that baffle manufacturing processes are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A baffle for a flue, the baffle comprising:

a strip of material which comprises:

a plurality of holes along a length of the strip of material, and a plurality of bent blades along the length of the strip of material, wherein each hole of the plurality of holes is adjacent one bent blade of the plurality of bent blades, each hole being configured to permit flue gas to pass therethrough, wherein each bent blade of the plurality of bent blades comprises an aperture formed therethrough, the aperture configured to permit flue gas to pass therethrough, and wherein the plurality of apertures forms an alternating pattern in which a first two apertures are disposed along a first lateral side of the strip of material, a second two apertures are disposed along a second lateral side of the strip of material, and a third two apertures are disposed along the first lateral side of the strip of material.

2. The baffle of claim 1, wherein the plurality of bent blades forms an alternating pattern with a first blade extending from a first side of the baffle and an adjacent blade extending from a second side of the baffle that is opposite the first side of the baffle.

3. The baffle of claim 1, wherein each of the plurality of bent blades comprises a gusset thereby increasing a rigidity of each of the plurality of bent blades.

4. The baffle of claim 1, wherein each of the plurality of bent blades forms an acute angle with the strip of material.

5. The baffle of claim 1, wherein each of the plurality of bent blades forms a 90 degree angle with the strip of material.

6. The baffle of claim 1, wherein the plurality of bent blades includes a first plurality of shorter blades and a second plurality of longer blades, the first plurality of shorter blades being located proximate a combustion end of the baffle and the second plurality of longer blades being located proximate a hanger end of the baffle.

7. A flue baffle comprising:

a strip of material which comprises a plurality of holes along a length of the strip of material, each hole being configured to permit flue gas to pass therethrough; and a plurality of bent blades along the length of the strip of material, each of the plurality of bent blades forming an acute angle with the strip of material and each hole of the plurality of holes being adjacent one bent blade of the plurality of bent blades, wherein each bent blade of the plurality of bent blades comprises a single aperture configured to permit flue gas to pass therethrough, and wherein the single apertures of the plurality of bent blades form an alternating pattern in which a first two apertures are disposed along a first lateral side of the strip of material, a second two apertures are disposed along a second lateral side of the strip of material, and a third two apertures are disposed along the first lateral side of the strip of material.

8. The flue baffle of claim 7, wherein the plurality of bent blades includes a first plurality of shorter blades and a second plurality of longer blades, the first plurality of shorter blades being located proximate a combustion end of the baffle and the second plurality of longer blades being located proximate a hanger end of the baffle.

* * * * *